US009514730B2

(12) United States Patent
Junod

(10) Patent No.: US 9,514,730 B2
(45) Date of Patent: Dec. 6, 2016

(54) WHISTLE DEVICE THAT CAN BE INTEGRATED INTO A WRISTWATCH

(71) Applicant: MONTRES JAQUET DROZ SA, La Chaux-de-Fonds (CH)

(72) Inventor: Francois Junod, Sainte-Croix (CH)

(73) Assignee: MONTRES JAQUET DROZ SA, La Chaux-de-Fonds (CH)

( * ) Notice: Subject to any disclaimer, the term of this patent is extended or adjusted under 35 U.S.C. 154(b) by 164 days.

(21) Appl. No.: 14/417,475

(22) PCT Filed: Jul. 9, 2013

(86) PCT No.: PCT/EP2013/064502

§ 371 (c)(1),
(2) Date: Jan. 26, 2015

(87) PCT Pub. No.: WO2014/019820

PCT Pub. Date: Feb. 6, 2014

(65) Prior Publication Data

US 2015/0187346 A1 Jul. 2, 2015

(30) Foreign Application Priority Data

Jul. 31, 2012 (CH) ..... 1232/12

(51) Int. Cl.

| | |
|---|---|
| ***G10K 5/00*** | (2006.01) |
| ***G04B 21/00*** | (2006.01) |
| ***G04B 47/04*** | (2006.01) |
| ***G04B 25/06*** | (2006.01) |

(52) U.S. Cl.

CPC ..... *G10K 5/00* (2013.01); *G04B 21/00* (2013.01); *G04B 25/06* (2013.01); *G04B 47/044* (2013.01)

(58) Field of Classification Search

CPC ..... G10K 5/00; G04B 21/00; G04B 47/00; G04B 47/04

USPC ..... 116/137 R; 368/272, 273; 968/225, 226, 968/227

See application file for complete search history.

(56) References Cited

U.S. PATENT DOCUMENTS

| | | | | |
|---|---|---|---|---|
| 454,369 | A | 6/1891 | Mahle | |
| 2,504,811 | A | 4/1950 | Davis et al. | |
| 2,574,703 | A * | 11/1951 | Paul et al. | G04B 21/08 368/272 |
| 2,608,795 | A | 9/1952 | Marcell | |
| 2,953,869 | A | 9/1960 | Collischan | |
| 3,200,538 | A | 8/1965 | Glass et al. | |
| 4,095,409 | A * | 6/1978 | Palum | G04B 21/02 116/169 |
| 4,098,068 | A * | 7/1978 | Masuyama | G04B 25/06 368/272 |
| 4,202,165 | A | 5/1980 | Jauch | |

(Continued)

FOREIGN PATENT DOCUMENTS

| | | | | |
|---|---|---|---|---|
| EP | 0 564 407 A1 | | 10/1993 | |
| FR | 2 250 147 A1 | | 5/1975 | |
| JP | 11-327417 A | | 11/1999 | |
| JP | 2009134176 A | * | 6/2009 | G10K 5/00 |
| JP | 3179592 U | * | 11/2012 | G10K 5/00 |

(Continued)

OTHER PUBLICATIONS

International Search Report for PCT/EP2013/064502 dated Sep. 6, 2013.

*Primary Examiner* — R. A. Smith
(74) *Attorney, Agent, or Firm* — Sughrue Mion, PLLC

(57) ABSTRACT

Device (1) that can be integrated into a wristwatch case comprising a whistle (7) and a piston (11) for injecting air into the whistle (7) in order to imitate the singing of a bird.

17 Claims, 3 Drawing Sheets

(56) References Cited

U.S. PATENT DOCUMENTS 5,522,756 A 6/1996 Barthold
D433,340 S * 11/2000 Lo ..... D10/2

FOREIGN PATENT DOCUMENTS

TW 420742 U * 1/2012 ..... G10K 5/00
WO 00/011523 A1 3/2000

* cited by examiner

WHISTLE DEVICE THAT CAN BE INTEGRATED INTO A WRISTWATCH

CROSS REFERENCE TO RELATED APPLICATIONS

This application is a National Stage of International Application No. PCT/EP2013/064502 filed Jul. 9, 2013, claiming priority based on Swiss Patent Application No. 01232/12 filed Jul. 31, 2012, the contents of all of which are incorporated herein by reference in their entirety.

TECHNICAL FIELD

The present invention relates to a whistle device that can be integrated into a wristwatch.

PRIOR ART

Clock devices fitted with a whistle or another device for imitating the singing of a bird are known in the prior art.

Wristwatches fitted with a device for generating a singing are known in the prior art.

Clock devices fitted with a whistle to imitate the singing of a bird are also known. Such whistles are also used in automata such as whistling or songbirds.

Songbirds are known in particular in cuckoo clocks or snuff boxes. The cuckoo clock concept was created around 1738 in the Black Forest. Traditionally, these clocks have a visible balance animated by weights and a decorated case in the form of a chalet. The doors of the chalet open every hour or half hour and a mechanical bird springs up from its nest and sings. The cuckoo call is generated by at least one whistle actuated by means of a bellows driven by the clock mechanism. Nowadays, cuckoo clocks mostly comprise a quartz movement and electronic striking mechanisms.

The usual operating devices for whistles comprise one or more bellows systems. The movement of the bellows enables generation of a pressure of air sent to the whistle to produce a sound.

The bellows are usually fabricated from wood and leather (goldbeater's skin) or paper. The major disadvantage of the bellows systems is that they allow air to escape when they are operated and thus produce noise that interferes with the melody of the songbird.

Moreover, frequent use of the bellows, humidity, natural aging can cause wear of the goldbeater's skin, in particular at the folds of the bellows. Wear results in increasingly significant leaks of air, which reduce the efficiency of the bellows and interfere with the melody of the songbird.

In addition, bellows require a significant amount of space and are therefore difficult to integrate into a miniature device.

Document U.S. Pat. No. 4,202,165 describes a cuckoo clock without a bellows. Flaps or shutters are raised or lowered by means of cams and as a result of their movement generate a jet of air towards one or two whistles in order to alternately emit two sounds imitating the singing of the cuckoo. This solution has the advantage of producing a cuckoo song of two notes without resorting to the use of bellows. However, the major disadvantage of this system is that it only produces two notes.

Document U.S. Pat. No. 2,504,811 describes a table clock comprising a case, in which a clock movement is located, and located above this case is a cage, in which a whistling bird is located. The device allows a tune composed of different notes to be played and at the same time one or more parts of the bird, such as the beak, tail or wings, to be moved. A bellows enables a pressure of air to be generated at the opening of the whistle. One end of a piston reciprocates inside the whistle to modulate the notes played by the whistle. The other end of the piston is connected to a cam driven by a toothed wheel. The distribution of the teeth on the toothed wheel allows the frequency and amplitude of the movement of the piston in the whistle, and thus the height of the notes played, to be controlled. This toothed wheel also enables actuation of the bellows and that of the bird. The major disadvantage of this device is that a bellows is used for injecting air into the whistle and it therefore is subject to the aforementioned disadvantages. Furthermore, this bellows device is bulky and cannot be integrated into a wristwatch case.

Therefore, there is a need for a robust miniature whistle system intended for imitating the singing of a bird that can avoid at least one of the disadvantages of the mentioned known devices.

BRIEF SUMMARY OF THE INVENTION

Therefore, it is an object of the present invention to propose a device that whistles a bird call that can be integrated into a watch case and is not subject to the limitations of known devices.

Another object of the present invention is to propose a device for supplying air to a whistle of small dimension.

According to the invention this object is achieved in particular by means of a device according to claim 1.

The device according to the invention therefore replaces the bellows of the prior art with a piston, which enables air to be injected into a whistle that imitates the singing of a bird.

The use of a piston means in particular that there is no generation of noise interfering with the singing of a bird. Moreover, a piston-cylinder assembly occupies less space than a bellows. It is therefore possible to integrate the piston device into a watch case.

In the context of the invention "whistle" is understood to be any element that has at least one air inlet and at least one air outlet that allows at least one sound to be generated when air is injected into the air inlet.

"Piston" is understood to mean a cylindrical part that moves in a cylinder in order to compress a volume of air.

According to an aspect of the invention the device can comprise a reservoir of compressed air between the cylinder and the whistle. Operation of the piston enables the air pressure in the reservoir of compressed air to increase.

The device according to the invention can comprise at least one first one-way valve upstream of the reservoir and downstream of the cylinder in order to prevent the return of compressed air to the cylinder.

According to an aspect of the invention this first one-way valve downstream of the cylinder can comprise an opening and a membrane intended to move depending on the pressure difference between the two sides of the valve such that when the pressure in the cylinder is higher than the pressure in the compressed air reservoir, the membrane moves away from the opening of the valve and allows the air to pass from the cylinder to the compressed air reservoir, but when the pressure in the cylinder is lower than the pressure in the reservoir, the membrane is pushed against the opening of the valve, which is thus closed.

The piston can move in the cylinder. A second one-way valve can be provided upstream of the cylinder in order to allow the entry of air into the body of the cylinder.

According to an aspect of the invention this second one-way valve upstream of the cylinder can comprise a membrane intended to move under the action of a pressure such that when the pressure in the cylinder is higher than the pressure outside the cylinder, the membrane is pushed against the opening closing the valve, whereas when the pressure in the cylinder is lower than the pressure outside the cylinder, the membrane moves away from the opening of the second valve enabling air to enter the cylinder.

The device for injecting air into the reservoir is thus formed by a piston pump.

According to an aspect of the invention the device can comprise a double-action piston pump that is capable of pumping air into the reservoir, irrespective of the direction of movement of the piston. In this case the cylinder can be linked to two second valves upstream of the cylinder in order to control the entry of air into each space of the cylinder on either side of the piston. The cylinder can be linked to two first valves downstream of the cylinder in order to control the outlet of compressed air towards the reservoir from each space of the cylinder on either side of the piston.

The use of four valves thus allows air to be injected from the cylinder to the compressed air reservoir in both directions of movement of the piston. When the piston moves in a first direction, the pressure in a first space on one side of the piston decreases until it becomes less than the external pressure, which causes the opening of the second valve upstream of the cylinder and allows air to enter this first space of the cylinder. Since the pressure in this first space is lower than that of the compressed air reservoir, the first downstream valve between this first space and the reservoir is closed. At the same time, the second space of the cylinder on the other side of the piston retracts so that the pressure in this second space becomes higher than that of the compressed air reservoir, which causes the opening of the first valve located downstream of the piston and allows air to be injected into the compressed air reservoir. Since the pressure in this second space is higher than the external pressure, the second valve upstream of the second space is closed and presents the air from leaving this second space to the outside. When the piston is actuated in the other direction, the pressure differences are reversed so that the two open valves close and the two closed valves open in order to fill the second space with outside air and pump compressed air into the reservoir from the first space. Therefore, the device allows air to be injected into the compressed air reservoir in both directions of movement of the piston.

The device can comprise a second piston in order to modify a space in the whistle to modify the height of the sound produced by the whistle when the air is injected therein from the compressed air reservoir (or directly from the first piston).

A cam can be provided to control the position of the second piston in order to produce a modulated singing imitating the singing of a bird. The second piston can be connected to the cam by means of a lever.

The movements of the lever driven by the cam are transmitted to the second piston in order for it to slide in the whistle, thus modifying the volume of air in the whistle. The whistle can thus emit various sounds.

"Cam" is understood to be a mechanical connecting element that enables a rotation movement to be transformed into a translational movement. A cam can be formed by a non-circular part set in rotation, on which a rod or a finger rests.

According to an aspect of the invention the device can comprise a valve positioned between the compressed air reservoir and the whistle.

In the device according to the invention the valve can be controlled by a cam in order to modulate the quantity of air injected into said whistle to modify the rhythm and/or the duration and/or the volume of the sounds produced by the whistle. The valve can be connected to a cam or to the same cam as the second piston by means of a lever.

The opening or closing of this valve allows the pressure of the air entering the whistle to be controlled. The compressed air of the reservoir is injected into the whistle when the valve is open. The flow of air entering the whistle is regulated by the movement of the valve. The frequency of opening and closing of the valve determines the rhythm of the sounds produced by the whistle. The rhythm of the notes emitted by the whistle is identical to the rhythm of operation of the valve. If the valve is operated rapidly, the notes are whistled rapidly. The duration of opening of the valve determines the length of the notes whistled. When the valve is open for a long time, a flow of air enters the whistle over a long time and produces a long sound. The amplitude of movement of the valve determines the quantity of air entering the whistle. Thus, the wider the valve is opened, the more significant the pressure of the air entering the whistle and the louder the sound emitted by the whistle.

The pressure in the compressed air reservoir can be limited by means of an excess pressure valve, which allows the air to escape to the outside when the pressure difference between the reservoir and the outside exceeds a threshold.

The device according to the invention can comprise a motor element that drives the cams.

In the device according to the invention the motor can comprise a barrel. The barrel comprises a spring positioned inside a frame. The spring-back of the barrel spring causes the rotation of the barrel. The cams controlling the opening and closing of the air inlet valve in the whistle and the movements of the second piston modifying the volume of air in the whistle are driven to rotate by the barrel. The shape of the cams allows control of the movement of the levers operating the valve and the second piston. Thus, when the barrel rotates, the cams also rotate and by means of levers control the opening and closing of the air inlet valve in the whistle and the movements of the second piston modifying the volume of air in the whistle.

The barrel has an external toothing. The external toothing of the barrel meshes with at least one wheel of a kinematic chain connecting the barrel to the first piston that supplies the compressed air reservoir in order to pump air more rapidly.

The cams controlling the movements of the air inlet valve in the whistle and the movements of the second piston modifying the volume of air in the whistle can be driven by the same motor element or by separate motor elements.

In a variant a single cam can be used. In this case the same cam can control the opening and closing of the air inlet valve in the whistle and the movements of the second piston modifying the volume of air in the whistle.

In the device according to the invention the speed of rotation of the cam or the cams is in the range of between 1 rotation in 2 seconds and 1 rotation in 20 seconds. The speed of rotation of the cam or cams is preferably in the range of between 1 rotation in 5 seconds and 1 rotation in 10 seconds.

The cam can be mounted directly on the operating barrel of the whistle mechanism.

When several cams are used, the cams can be superposed on the barrel. Cams can also be mounted on other wheels of the kinematic chain.

The device according to the invention can additionally comprise an eccentric in the kinematic chain that connects the barrel to the first piston.

The eccentric is connected to a rod that operates the first piston that supplies the compressed air reservoir.

The speed of rotation of the eccentric can be in the range of between 5 and 15 rotations/second, preferably between 8 and 10 rotations/second.

These speeds of rotation of the eccentric allow a rapid movement of the pump that guarantees a pressure in the air reservoir that is sufficient to operate the whistle.

The device according to the invention can comprise a clock movement to display the current time. This clock movement can be independent of the operating mechanism of the whistle and comprise a second barrel.

In a variant the same barrel can be used to drive a watch movement and to operate the whistle device according to the invention.

The device according to the invention can comprise a regulating organ to control the kinematic chain between the motor element and the first piston.

The use of a regulating organ in particular allows the rotation of the barrel to be slowed down in order to control the movement of the first piston and the entry of air into the compressed air reservoir. In the context of the invention the regulating organ is not necessarily as precise as the regulating organ of a watch movement. It allows the spring-back of the barrel spring and therefore the rotation of the barrel to be braked. When the barrel is activated, the initially wound barrel spring springs back. The speed of spring-back of the spring and the rotation of the barrel are slowed down by losses along the kinematic chain and by the presence of a regulating organ. The movement of the first piston connected to the kinematic chain is therefore also braked by the regulating organ.

In the framework of the invention a regulating organ can comprise a wheel having inertia blocks. The inertia blocks positioned appropriately on the wheel allow control of the rotation movement of the wheel carrying them and other wheels of the kinematic chain.

The device according to the invention can comprise an actuator that can be operated manually by the user in order to activate the whistle manually. The operation of the actuator enables the motor element that operates the whistle to be set in operation.

In a variant the activation of the whistle can also be conducted automatically, e.g. on the passage of hours, half hours or even quarter hours. The activation of the whistle can also be conducted in a programmed manner, e.g. by means of a function of the watch, e.g. an alarm, date function etc.

The device according to the invention can additionally comprise an articulated figure operated by a wheel of the kinematic chain. The term figure denotes both humans and animals here.

A cam or another mechanical device can enable the articulated figure to be operated from the kinematic chain.

In the device according to the invention the articulated figure comprises a figurine, e.g. a songbird.

In the context of the invention a songbird is a mechanical bird that has one or more parts that are capable of moving. The movable parts of the bird can include the wings, beak and/or tail. Inside the bird mechanical connections allow these different parts to move simultaneously or not.

The device according to the invention can permit simultaneous operation of the whistle and the articulated figure.

Since the animation of the articulated figure is controlled by a wheel of the kinematic chain, it can be coordinated with the notes played by the whistle.

The device according to the invention therefore has the advantage over the known prior art that it produces a bird singing whistled by means of a whistle supplied with air by means of a piston that can be integrated into a watch case.

BRIEF DESCRIPTION OF THE FIGURES

Example of embodiments of the invention are indicated in the description illustrated by the attached figures, in which.

EXAMPLES OF EMBODIMENTS OF THE INVENTION

Figure 1:
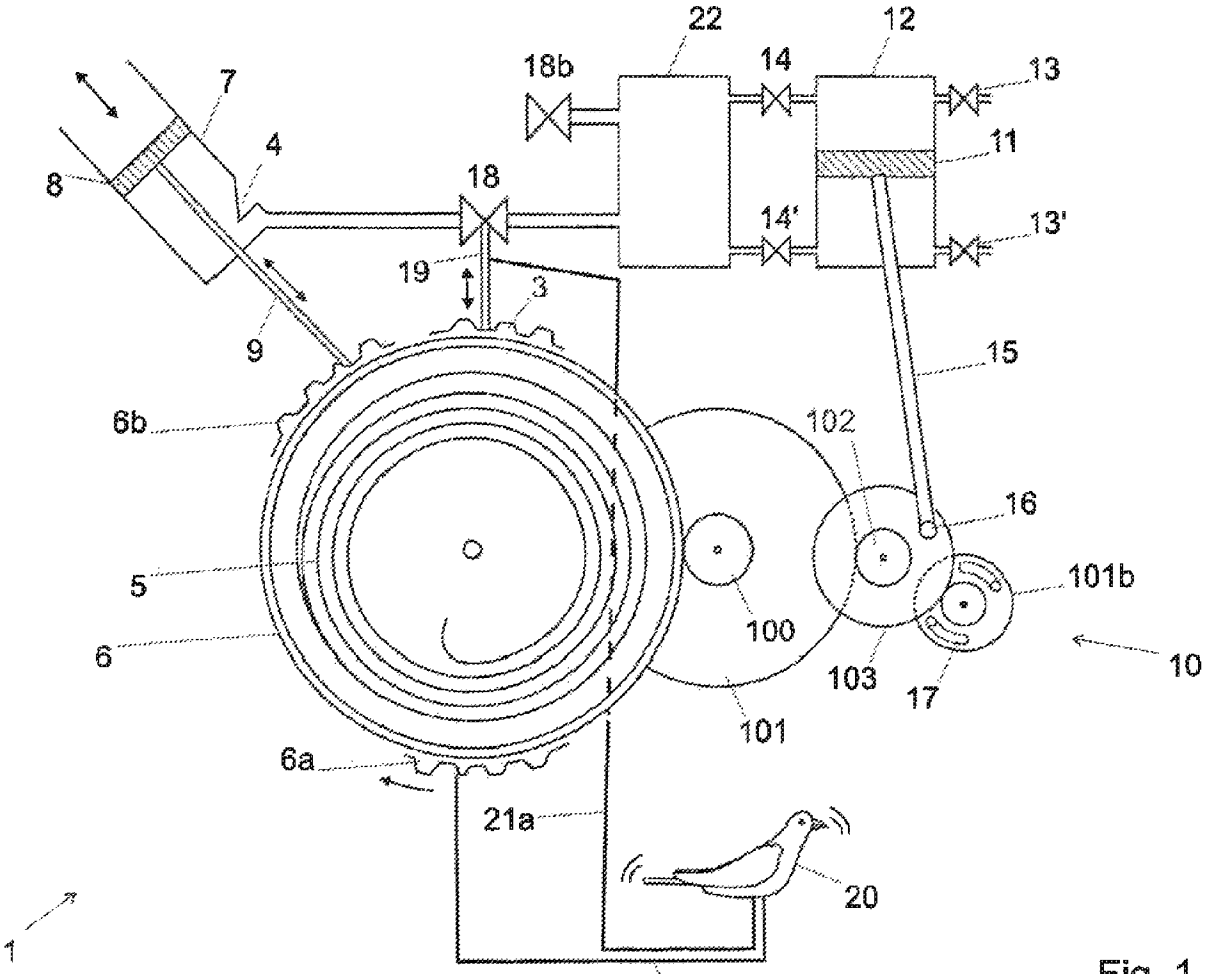
FIG. 1 shows an operational chart of the device according to an embodiment of the invention.

FIG. 1 shows a functional diagram showing the device 1 according to an embodiment of the present invention. The dimensions and shapes of the elements are illustrated solely for instructive purposes and the dimensions and proportions of the real device can be different.

This device 1 has in particular a barrel 5 fitted with an external toothing 6 meshing with a pinion 100 of a kinematic chain 10. The pinion 100 is mounted on the axis of a wheel 101 driving a second pinion 102 on the axis of the wheel 103. The gear ratio between the barrel 5, which performs a rotation in two seconds, for example, and the wheel 103, which performs ten rotations per second, for example, is advantageously in the range of between 1/5 and 1/50, e.g. 1/20. This speed ratio can also be obtained with a different number of wheels and pinions (at the same time referred to as wheels) in the kinematic chain 10.

The barrel 5 is also fitted with cams 3, 6*a*, 6*b*, e.g. cams mounted on its periphery, in order to operate different elements of the whistle mechanism 7 and/or animate a FIG. 20.

Figure 2A:
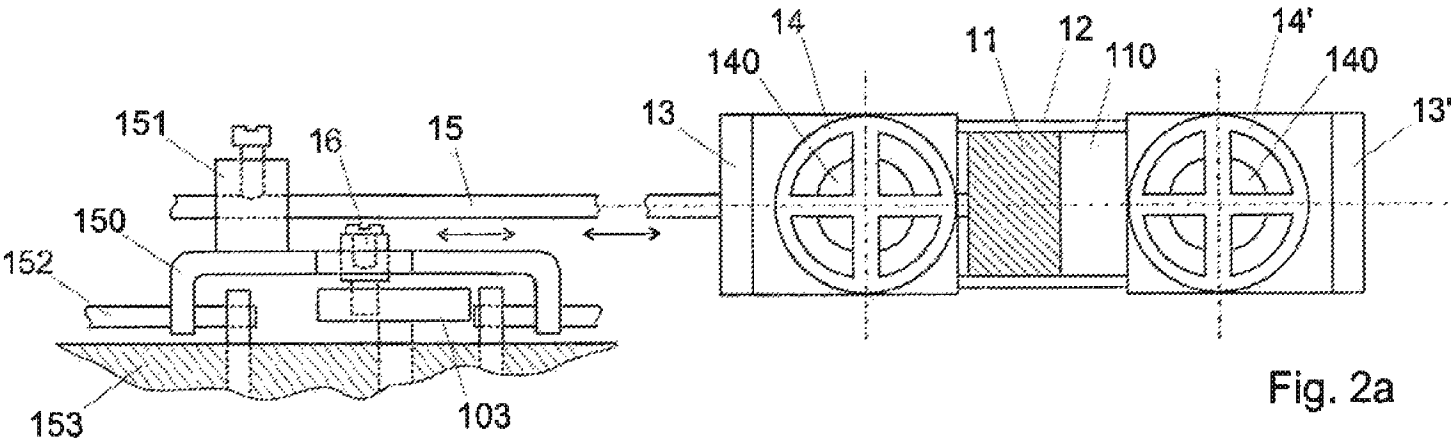
FIG. 2*a* shows a longitudinal section showing the first piston and its operating system with a rod according to a second embodiment.
Figure 2B:
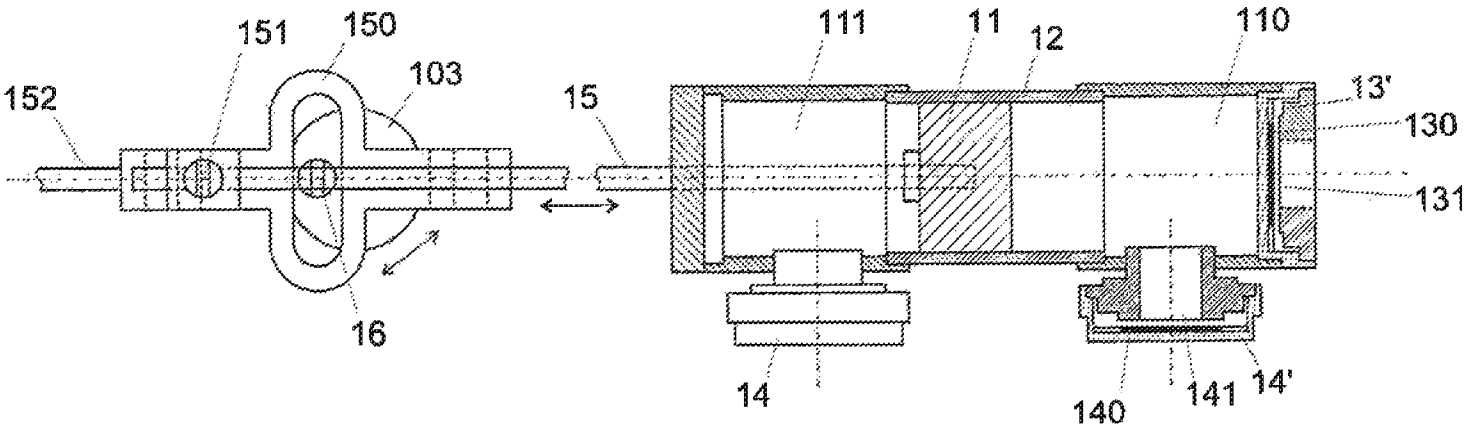
FIG. 2*b* shows a section in plan view showing the first piston and its operating system with a rod according to a second embodiment.

The wheel 103 is fitted with an eccentric 16 or a cam for driving the first piston 11 by means of the rod 15. The first piston (or pumping piston) thus performs an alternating movement in the cylinder 12, at ten pumping cycles per second for example. A first variant of a rod 15 is illustrated in FIG. 1 and has the disadvantage that it requires an articulated fixture to the piston 11 and covers a significant surface area during its movements. A second variant of a rod 15 avoiding these disadvantages is shown in FIGS. 2*a* and 2*b*.

The cylinder 12 can be formed by a cylindrical tube made of steel, aluminium, titanium, brass etc., for example. In an advantageous embodiment the cylinder 12 is made of glass, which has the advantage that it does not require lubrication and allows the movement of the piston 11 in the cylinder to be observed, e.g. through a transparent base of the watch case.

The first piston 11 supplies a compressed air reservoir 22 with air. The reservoir is connected to the whistle 7 by means of a valve 18.

The kinematic chain 10 additionally comprises a regulating organ 17 formed here by inertia blocks on one of the wheels 101*b* downstream of the wheel 103. The inertia blocks 17 move away from the centre of rotation of the wheel 101*b* when this starts to rotate, and this increases its moment of inertia and tends to slow down and control its speed and that of the whole of the kinematic chain. Other regulating mechanisms, including mechanisms based on a spring balance, brakes etc., can be used.

One or more of the wheels of the kinematic chain 10, e.g. the cams 3 and 6*a*, are connected to an articulated FIG. 20, e.g. a mechanical bird or another animated figure perpendicular to the dial, by means of connecting elements 21 and 21*a* in order to actuate this wheel when the kinematic chain rotates.

The second piston 8 slides into the body of the whistle 7. The second piston is moved by means of a lever 9 driven by a cam 6*b* connected to the barrel 5 or on another wheel of the kinematic chain. The valve 18 is also operated by a lever 19 driven by a cam 3 on the axis of the barrel 5. In another embodiment the valve 18 is automatic and opens as soon as the pressure difference between the reservoir 22 and the outside exceeds a first threshold.

A second automatic valve 18*b* opens as soon as the pressure difference between the interior of the reservoir 22 and the outside exceeds a second threshold in order to prevent an excess pressure in this reservoir. The piston 11 preferably generates sufficient pressure in the reservoir so that the valve 18*b* must open regularly, and thus the pressure in the reservoir 22 remains substantially constant fluctuating around the value that activates the opening of the valve 18*b*.

Operation of the Air Supply Circuit of the Whistle 7

The first piston 11 works as a pump to supply the compressed air reservoir 22 with air. The operation of the first piston 11 is controlled by the barrel 5 by means of the rod 15 connected to the eccentric 16. The movement of the piston 11 is thus controlled by the barrel 5 via the kinematic chain 10, wherein the rotation of the barrel causes a rapid pumping of air into the reservoir 22.

The first piston 11 is connected to the compressed air reservoir 22 by one or more one-way valves 14, 14'. These valves 14, 14' allow the passage of air from the piston 11 to the reservoir 22 and prevent the passage of air from the reservoir 22 to the piston. The cylinder 12 additionally comprises one-way valves 13, 13' that allow outside air to enter the body 12 of the piston 11. When it is operated in one direction, the piston 11 sucks in outside air through the valve 13' and expels a flow of air through the valve 14 into the compressed air reservoir 22 in order to fill it. In the opposite direction the piston 11 sucks in outside air through the valve 13 and expels a flow of air through the valve 14' into the compressed air reservoir 22 in order to fill it. The use of one-way valves 14, 14' prevents the return of compressed air from the reservoir 22 to the piston 11.

In this embodiment the piston 11 can supply air to the compressed air reservoir 22 in two directions of operation.

The detailed operation of the valves 13, 13', 14 and 14' will be described further below.

The reservoir 22 is connected to the whistle 7 via the valve 18. The progressive opening of the valve is controlled by the kinematic chain 10 in order to control the air pressure in the whistle 7 at every moment. The valve 18 is operated by the cam 3 by means of a lever 19 to allow compressed air exiting the reservoir 22 to enter the whistle 7 and to exit from it via the air outlet 4. In this embodiment the cam 3 is carried by the barrel 5 and rotates at the same speed. The valve 18 can occupy an open position, in which it lets air enter the whistle 7, or a closed position, in which it prevents air from entering the whistle 7. In another embodiment these positions can be reversed. When the lever 19 comes into contact with an apex or hump of the cam 3, it passes to a high position corresponding to an opening position of the valve 18, which allows air from the compressed air reservoir 22 to enter the whistle 7 and enables at least one sound to be played. When the lever 19 is located in a hollow of the cam 3, it is in a low position corresponding to a closing position of the valve 18. The valve then blocks the entry of air into the whistle 7 and prevents the whistle 7 from emitting a sound.

The frequency of opening and closing of the valve 18 determines the rhythm of the sounds produced by the whistle. The rhythm of the sounds emitted by the whistle 7 is identical to the rhythm of operation of the valve 18. If the valve is operated at short intervals, the notes are whistled at short intervals. This situation corresponds to an area of the profile of the cam 3 that has humps close together. Conversely, an area of the profile of the cam 3 that has humps far apart corresponds to repeated openings of the valve 18 at long intervals and to sounds emitted by the whistle 7 at long intervals.

The duration of opening of the valve 18 determines the length of the notes whistled. When the valve 18 is open for a long time, a flow of air enters the whistle 7 over a long time and produces a long sound. An opening of the valve 18 for a long time corresponds to a hump having a broader apex. Conversely, an opening of the valve 18 for a short time corresponds to a hump having a narrower apex. A short opening of the valve 18 limits the entry of air into the whistle 7 to a short duration and this then plays a short note.

The amplitude of the movement of the valve 18 determines the air flow entering the whistle 7. Thus, the wider the valve 18 is opened, the more significant the air flow entering the whistle 7 and the louder the sound emitted by the whistle 7. The amplitude of the movement of the valve 18 is determined by the height and shape of the humps and hollows forming the profile of the cam 3. The height of a hump of the profile of the cam 3 determines the air flow entering the whistle 7 and therefore the sound volume emitted.

In a variant the valve 18 can be operated automatically by the pressure in the reservoir 22, which causes it to open from a pressure threshold.

The whistle 7 has a lever 9 connected to a second piston 8, which moves in the body of the whistle 7 that forms a cylinder. The operation of the second piston 8 in the body of the whistle 7 is controlled by the cam 6*b* on the periphery of the barrel 5 or by another cam on this barrel or on another wheel. The position of the piston 8 in the body of the whistle 7 determines the volume of air in the body of the whistle 7. The position of the piston 8 in the body of the whistle 7 is determined by the shape of the cam 6*b* conveyed by the lever 9 or by a system of levers. When the end of the lever 9 is located at the apex of a hump of the cam 6*b*, the piston 8 occupies a high position in the body of the whistle 7. The volume of air present in the body of the whistle 7 is thus significant, which allows a low note to be played when the valve 18 is open. Conversely, the note will be high-pitched when the piston 8 occupies a low position in the whistle 7. The height of the sounds emitted by the whistle depends directly on the volume of air present in the whistle 7. The smaller the volume of air present in the whistle 7, the higher-pitched the sound emitted by the whistle 7, and vice versa.

The lever 9 can also be connected to the other face of the piston in the open space of the whistle to avoid a joint at the insertion point of the lever 9 into the whistle 7.

The humps and hollows forming the profile of the cam 6*b* determine the volume of air present in the body of the whistle 7; the shape of the cam thus allows the height of the sounds emitted by the whistle 7 to be modulated. The notes of a melody and their sequence are determined by the shape of cam 6*b* and cam 3 respectively.

In one embodiment a single cam 3 drives the levers 9 and 19. In another embodiment two separate cams 3, 6*b* are provided to operate these two levers.

Operation of the Device Assembly

The activation of the barrel 5 thus enables a device 1 that imitates the singing of a bird to be activated.

A rotation of a barrel 5 turn allows the device 1 to whistle the motif once. When the barrel 5 is charged, it can perform several turns, e.g. five turns, and this corresponds to five successive repetitions of the same musical motif. Once the five turns have been performed, the barrel 5 is discharged and the whistle 7 can no longer emit any note before the barrel is recharged again manually or by means of an automatic winding mechanism.

Besides the musical motif, the activation of the barrel 5 drives the animation of an articulated FIG. 20 by means of mechanical connecting elements or levers 21 and 21*a*. In this embodiment the articulated figure is a mechanical bird 20 having several parts that can move, e.g. the head, tail and wings. The rotation of the bird 20 on itself in a plane parallel to the dial of the watch is controlled by an additional cam 6*a* on the periphery of the barrel 5 or on another wheel. A rack (not shown) can be provided between the cam 6*a* and the bird in order to perform reciprocating rotation movements.

The animation of the beak, tail and/or wings is controlled by the cam 3 that also operates the valve 18 or by an additional cam on the periphery of the barrel 5 or by another wheal by means of a lever 21*a*. The lever 21*a* can be coaxial to lever 21. The lever 21 can perform rotation movements on its longitudinal axis, whereas lever 21*a* can perform longitudinal translational movements along its own axis in order to operate a mechanism in the body of the bird.

The connecting element 21*a* can comprise several shafts in order to control different parts of the articulated FIG. 20 independently, e.g. by means of different coaxial shafts.

Thus, the activation of the device 1 simultaneously allows a bird singing to be emitted by means of the whistle 7 and an articulated figure to be animated.

The activation can be provided automatically every hour, as is the case with a cuckoo clock, every quarter hour, or at another predetermined time interval. The device 1 can also be activated by an alarm function of the movement of the watch.

In an embodiment an actuator (not shown) can be provided to enable a user to activate the device 1 manually. An actuator such as a pushbutton can be used. Any other type of actuator can also be used. The operation of this actuator in particular allows the barrel 5 to be charged, then its rotation to be activated in order to operate the device 1 that imitates the singing of a bird.

The device 1 can comprise a watch movement that is independent of the whistle device described above, e.g. a watch movement driven by another barrel. The whistle device 1 can also be controlled by this watch movement in order to automatically make a sound at predetermined times and/or driven by this watch movement rendering an additional barrel unnecessary.

In an embodiment the winding of the barrel 5 can be achieved by the winding element of the barrel of the watch movement, e.g. by the same crown or the same automatic winding mechanism. In an embodiment the winding of the barrel 5 is achieved by a winding element separate from the winding element of the barrel of the movement of the watch, e.g. another crown, an additional position of the crown, a winding lever or an independent automatic winding device.

In another embodiment, not shown, the motor element 5 can comprise an electric motor.

FIGS. 2*a* and 2*b* show in detail a cylinder 12-piston 11 assembly according to an embodiment of the invention. In this embodiment the valves 14, 14' downstream of the cylinder 12 are provided directly on the face of the cylinder 12 and connected to the reservoir 22 by ducts not shown in these figures.

The valves 14 and 14' work as non-return valves. Each valve comprises a membrane 140 that can move under the action of the pressure difference between the two sides of the valve.

Similar valves 13, 13' can be used upstream of the cylinder 12 to control the entry of air into the cylinder. These valves 13, 13' can be provided on the surfaces of the cylinder 12 or in air intake ducts to this cylinder.

In the case of valves 13, 13' the membrane 130 is subjected on one surface to the pressure exerted by the piston 11 in the corresponding space of the cylinder 12 and on the opposite surface to the pressure in the watch case. When the internal pressure in the first space 110 of the cylinder 12 is higher than the external pressure, the membrane 130 is pushed against the opening 131 and prevents any passage of air between this space 110 and the outside. When the pressure exerted by the piston 11 on the membrane 130 is lower than the external pressure, the membrane 130 is moved away from the opening 131 in the valve 13, 13', and this allows the passage of air into the cylinder 12.

In the case of valves 14, 14' the membrane 140 is subjected on one surface to the pressure in the corresponding space 110 or 111 of the cylinder 12 and on the opposite surface to the pressure in the compressed air reservoir 22. When the pressure in the cylinder 12 is higher than the pressure in the compressed air reservoir 22, the membrane 140 moves away from the opening 141 of the valve 14, 14' and lets air pass from the corresponding space 110 or 111 of the cylinder 12 to the compressed air reservoir 22. When the pressure inside the cylinder 12 is lower than the pressure exerted by the compressed air reservoir 22, the membrane 140 is pushed against the opening 141 of the valve 14, 14' and prevents any passage of air.

The membrane 130 or 140 is preferably sufficiently fine to be moved by a small pressure difference. An elastic element, e.g. a spring, can be provided to prestress the valve into a predetermined position, e.g. a closed position. The membrane is preferably made from a strong airtight material so that it can be operated rapidly and frequently without wearing.

In an embodiment of the invention the membrane is composed of a non-oxidising material, e.g. titanium or aluminium or an aluminium-based non-oxidising alloy known commercially under the name Peraluman.

In an embodiment, not shown, at least one of the valves 14, 14' can be placed at the entry to the compressed air reservoir 22.

The left-hand part of FIGS. 2*a* and 2*b* shows an example of the fixture of the rod 15 onto the eccentric 16 positioned on the wheel 103. In this example the end of the rod 15 is connected by a fastening 151 to a ring 150, in which the eccentric 16 can move perpendicularly to the rod 15. The movements of the eccentric 16 in the longitudinal direction of the rod 15 are transmitted to the ring 150 and the rod 15, whereas the movements of this eccentric along the perpendicular axis of the rod 15 can be performed freely in the ring 150 without causing movement of the rod 15, which thus remains perpendicular to the piston 11. The elements 152 are elements for guiding the ring 150 on the bottom plate 153 of the device 1.

Figure 3:
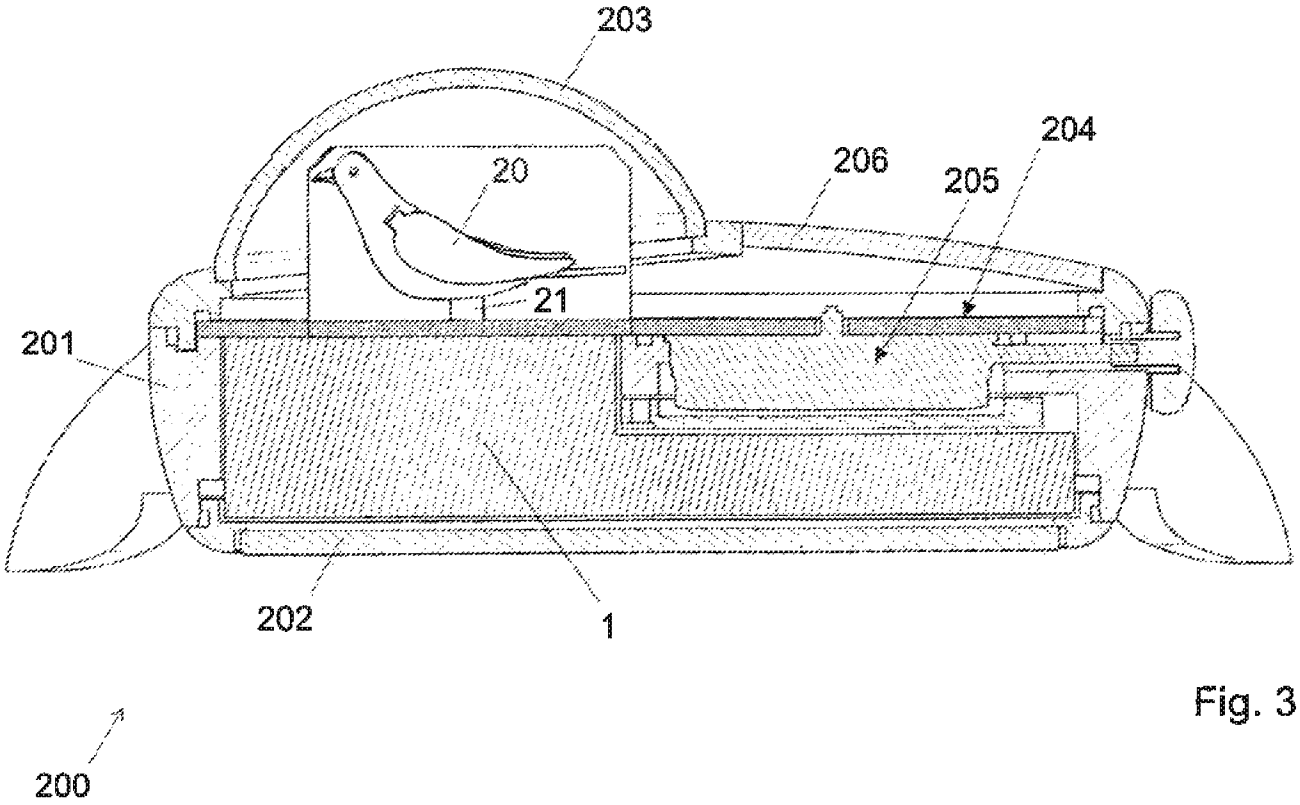
FIG. 3 shows a cutaway view of a watch case incorporating a watch movement as well as the device of the invention.

FIG. 3 shows a watch case 200 comprising the whistle device 1 according to an embodiment of the invention. The watch case comprises a middle 201, a bottom 202 and a glass 203, 206 in two parts glued or joined together, wherein one of the parts 206 covers the dial 204 with the hour display, while the most curved part of the glass 203 protects the songbird 20, which extends above this dial 204 perpendicularly to this dial, being driven to rotate by the lever or shaft 21. The connecting element 21*a* can pass through a longitudinal opening through the shaft 21. The element 205 is the watch movement, which in this embodiment is independent and does not cooperate with the whistle device and control device of the songbird 1. Devices are conceivable that integrate the whistle and/or songbird 20 on the same bottom plate as the watch movement or on an auxiliary module cooperating with this movement 205.

The barrel 5 of the device 1 that drives the whistle can be wound manually or automatically independently of the barrel of the movement 205, e.g. by means of a crown or an independent winding element. Alternatively, the barrel 5 of the device 1 that drives the whistle can be wound manually or automatically by means of a crown or a joint winding member with the movement 205.

REFERENCE NUMBERS USED IN THE FIGURES

1. Device
3. Cam
4. Air outlet of whistle
5. Barrel
6. Toothing
6*a*. Cam
6*b*. Cam
7. Whistle
8. Second piston
9. Lever
10. Kinematic chain
11. Piston
12. Cylinder
13, 13'. Second one-way valve
14, 14'. First one-way valve
15. Rod
16. Eccentric
17. Regulating organ
18. Third valve
18*b*. Excess pressure valve
19. Lever
20. Articulated figure
21. Mechanical connecting element (lever)
21*a*. Mechanical connecting element (lever)
22. Compressed air reservoir
100. Pinion
101. Wheel
101*b*. Speed regulator
102. Pinion
103. Wheel
110, 111. Spaces
130. Membrane
131. Opening
140. Membrane
141. Opening
150. Ring
151. Fastening of ring
152. Guide element
153. Plate
200. Watch case
201. Middle
202. Bottom
203. Part of the glass
204. Dial
205. Watch movement
206. Part of the glass

The invention claimed is:

1. A device that can be integrated into a wristwatch case, comprising:
- a whistle;
- a piston that slides into a cylinder to inject air into the whistle in order to imitate the singing of a bird,
- wherein said device comprises:
  - a compressed air reservoir between said piston and said whistle;
  - an excess pressure valve, which opens automatically as soon as the pressure difference between the interior and the exterior of the compressed air reservoir exceeds a threshold;
  - a third valve positioned between said compressed air reservoir and said whistle, wherein the third valve is controlled by a first cam by means of a lever in order to modulate the quantity of air injected into said whistle so as to modify the rhythm and/or duration and/or volume of the sounds produced by the whistle.

2. The device according to claim 1, wherein it comprises at least one first one-way valve upstream of said reservoir for preventing the return of compressed air to the cylinder.

3. The device of claim 2, wherein said at least one first one-way valve comprises an opening and a membrane arranged such that when the pressure in the cylinder is higher than the pressure in the compressed air reservoir, the membrane moves away from the opening and lets air pass from the cylinder to the compressed air reservoir, and such that when the pressure in the cylinder is lower than the pressure in the compressed air reservoir, the membrane is pushed against the opening of the valve and prevents any passage of air.

4. The device according to claim 3, wherein it comprises two first valves downstream of the piston and two second valves upstream of the piston.

5. The device according to claim 2, wherein it comprises two first valves downstream of the piston and two second valves upstream of the piston.

6. The device according to claim 1, wherein the cylinder is connected to at least one second one-way valve to allow the entry of air into the cylinder.

7. The device according to claim 6, wherein said at least one second one-way valve comprises an opening and a membrane arranged such that when the pressure in the cylinder is higher than the external pressure, the membrane is pushed against the opening and prevents any passage of air, and such that when the pressure in the cylinder is lower than the external pressure, the membrane moves away from the opening and allows the passage of air into the body of the piston.

8. The device according to claim 1, wherein said piston is arranged to supply air to the compressed air reservoir in both directions of operation.

9. The device according to claim 1, wherein it comprises a second piston in order to modify a space in said whistle so as to modify the height of the sound produced by the whistle.

10. The device according to claim 6, wherein it comprises a cam that drives a lever to modify the position of said second piston so as to produce a modulated singing that imitates the singing of a bird.

11. The device according to claim 1, wherein said cam that controls the third valve is carried by a barrel.

12. The device according to claim 1, wherein it additionally comprises a barrel, a kinematic chain connecting said piston to said barrel, wherein said kinematic chain comprises a rod that operates said piston.

13. The device according to claim 1, wherein it comprises a second barrel for driving a watch movement.

14. The device according to claim 1, wherein it comprises a regulating organ for controlling the displacement speed of said piston.

15. The device according to claim 1, wherein it comprises an actuator that can be operated manually by the user in order to manually activate said whistle.

16. The device according to claim 1, wherein it comprises an articulated figure actuated by said device.

17. The device according to claim 16, wherein the articulated figure comprises a bird.

* * * * *